US006694893B2

(12) United States Patent
Alcala et al.

(10) Patent No.: US 6,694,893 B2
(45) Date of Patent: Feb. 24, 2004

(54) ART TABLE

(75) Inventors: Jose Alcala, Fayetteville, AR (US); Sofia Dumery, Brooklyn, NY (US); Sun Chul Kim, Brooklyn, NY (US); Kimberly Leonard, Washington, DC (US); Andrew Schloss, New York, NY (US)

(73) Assignee: ABC School Supply, Inc., Duluth, GA (US)

( * ) Notice: Subject to any disclaimer, the term of this patent is extended or adjusted under 35 U.S.C. 154(b) by 151 days.

(21) Appl. No.: 10/068,439

(22) Filed: Feb. 5, 2002

(65) Prior Publication Data

US 2002/0069792 A1 Jun. 13, 2002

Related U.S. Application Data

(63) Continuation of application No. 09/479,116, filed on Jan. 7, 2000, now Pat. No. 6,363,865, which is a continuation-in-part of application No. 29/100,177, filed on Feb. 4, 1999, now Pat. No. Des. 423,254.

(60) Provisional application No. 60/115,741, filed on Jan. 13, 1999.

(51) Int. Cl.[7] ..... A47B 37/00

(52) U.S. Cl. ..... 108/50.17; 108/25

(58) Field of Search ..... 108/25, 27, 129, 108/50.17; 312/231, 34.8; 211/16, 45; 269/254 D, 16

(56) References Cited

U.S. PATENT DOCUMENTS

| | | | | | |
|---|---|---|---|---|---|
| 1,237,170 | A | * | 8/1917 | Cline | 108/90 |
| 1,480,168 | A | * | 1/1924 | Lambert | 108/50.17 |
| 2,507,931 | A | | 5/1950 | Pizzonia | 109/50.17 |
| 3,006,108 | A | * | 10/1961 | Condit | 108/28 |
| 4,167,264 | A | * | 9/1979 | Kretzmeir | |
| 4,239,195 | A | | 12/1980 | Oltman et al. | 269/16 |
| 4,437,714 | A | | 3/1984 | Struck | 312/281 |
| D273,829 | S | | 5/1984 | Desnoyers | D6/179 |
| 4,825,779 | A | | 5/1989 | Simms | 108/50.17 |
| 4,924,782 | A | * | 5/1990 | Nichoalds | 108/27 |
| D355,088 | S | | 2/1995 | Dobbs | D6/480 |

OTHER PUBLICATIONS

"Three–Tub Sand & Water Table"—p. 93 of ABC School Supply Catalog—Jan. 1996.
"Sand & Water Table"—p. 91 of ABC School Supply Catalog—Jan. 1996.
"Sand & Water Table with Birch Cover"—p. 88 of ABC School Supply Catalog—Jan. 1996.
"Rainbow Sand and Water Table"—p. 88 of ABC School Supply Catalog—Jan. 1998.
"Sand & Water Table"—p. 86 of ABC School Supply Catalog—Jan. 1998.

* cited by examiner

*Primary Examiner*—Lanna Mai
*Assistant Examiner*—Jerry A. Anderson
(74) *Attorney, Agent, or Firm*—Nicholas A. Kees; Godfrey & Kahn, S.C.

(57) ABSTRACT

An art table having a top surface, two ends, and a lower tray. Each end has two legs. A brace is placed at each end supporting a plurality of holders, where drawing materials can be placed. Wheels are attached to two legs of one end. A paper dispenser is placed under the top surface and holds a roll of paper, so that paper can be fed over the top surface for drawing. The lower tray serves as a brace to provide extra support for the table and also serves as a holding place for extra papers and drawing materials.

8 Claims, 3 Drawing Sheets

ART TABLE

CROSS REFERENCE TO RELATED APPLICATIONS

This a application is continuation of application Ser. No. 09/479,116, filed Jan. 7, 2000, now U.S. Pat. No. 6,363,865, is a continuation-in-part of application Ser. No. 29/100,177, filed on Feb. 4, 1999, now U.S. Pat. No. D423254, which claims the benefit of provisional application No. 60/115,741, filed Jan. 13, 1999 now abandon.

TECHNICAL FIELD

The present invention generally relates to children's furniture. More particularly, the present invention relates to a child's art table.

BACKGROUND

Before children can manage written language to express themselves, they will use drawings to express their imagination and their view of the world. Parents generally encourage their children to express their imagination and artistic aspirations by providing them with paper, crayons, pencils, etc. for drawing and coloring. Children are also encouraged to draw and color pictures from an early age in pre-school and kindergarten to promote learning. However, parents usually do not provide children with adequate and dedicated flat surfaces at home for making drawings. Children will make their drawings on kitchen tables, dining tables, living room coffee tables and/or even on floors, when adults are not supervising them properly. Children generally do not have a good concept of the consequences of their actions, however, and typically are not especially careful or neat when using paints, crayons and markers. Often color marks are left on tables, floors and walls, which marks are almost impossible to remove, and drawing papers, pencils and crayons are everywhere, requiring that someone, i.e., the parents, continually pick up and clean up the mess created by what should be a creative activity for their children.

For the foregoing reasons, there is a great need for an art table dedicated to children, whereby supplies of paper can be easily attached along with other drawing supplies, such as crayons, pencils, markers, etc., to remedy these and other related and unrelated problems.

SUMMARY

Briefly described, the present invention generally comprises an art table designed and built to serve as a centralized drawing station for storing and securing papers, crayons, markers and other art supplies. Children thus can have their drawing supplies, such as pencils, color markers, crayons, etc., readily available and will have a large space for drawing, where children can have fun time drawing, painting, etc., with any mess confined to the table area.

The art table is comprised of a top member that provides a substantially flat, solid, hard activity surface, on which children can make their drawings, supported by a support structure, and a paper dispensing assembly and a variety of supply holders and trays supported proximate to the activity surface by that same support structure.

In preferred embodiments, the activity surface is defined on an elongated plate-like top member, and the support structure includes two leg assemblies displaced from each other, one adjacent to each end of the top member. In preferred embodiments, an elongated tray is mounted to and extends between the two leg assemblies below the top member, a paper dispenser is supported under the top member, adjacent one end, and a plurality of same or variant shaped supply holders are supported by braces above the activity surface adjacent each end of the table top member. In preferred embodiments, the paper dispenser holds a roll of paper at one end of the table, from which paper is dispensed over and onto the top surface to provide a ready supply of paper for drawing. Wheels are, alternately, mounted on the leg assembly at one end of the table to aid in moving the art table.

Drawing supplies, such as paint, pencils, color markers, crayons, etc. can be placed into the supply holders for easy access. Lighting fixtures or devices also can be attached to the braces for providing additional illumination to the table. The lower tray also serves to provide additional storage space for drawing supplies or artwork by the children.

Various objects, features and advantages of the present invention will become apparent to those skilled in the art upon reading the following specification when taken in conjunction with the accompanying drawings.

DETAIL DESCRIPTION

Figure 1:
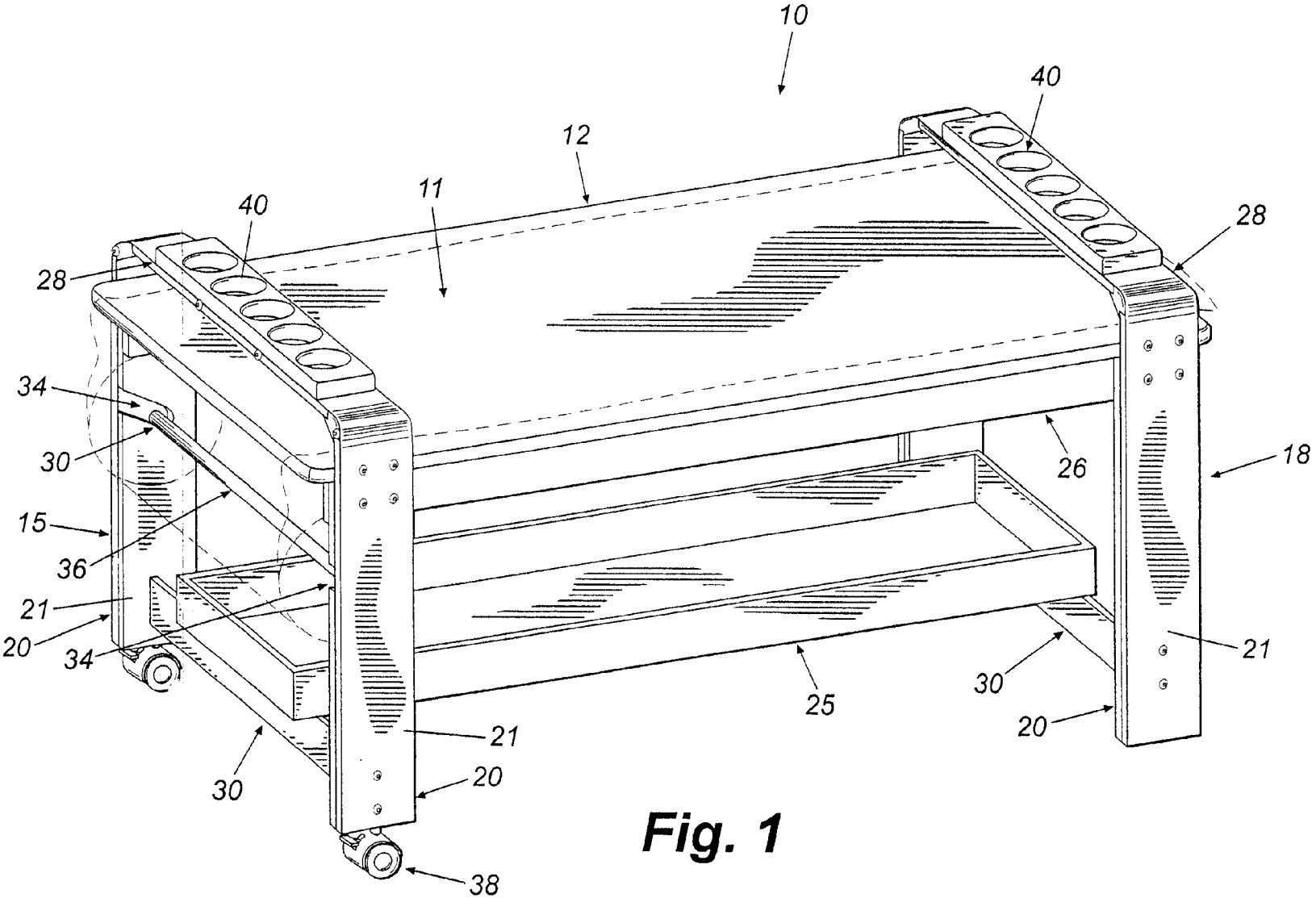
FIG. 1 is a perspective view of the art table of the present invention.

Referring now in more detail to the drawings in which like numerals refer to like parts throughout the several views, FIGS. 1–4 illustrate an art table 10, in accordance with one preferred and example embodiment of the present invention, for storing children's art supplies and providing a stable flat surface for children to prepare drawings, paintings and writing letters, etc. With reference to FIG. 1, the art table 10 generally includes a substantially flat table top 11 having an upper or top surface 12 to provide a drawing support surface. The art table 10 has a first end 15 and a second end 18, and leg or support assemblies 20, which, in the preferred embodiment, comprise legs 21 mounted in pairs at each end of the art table 10, adjacent the corners thereof. Generally, four legs 21 will be used, although additional pairs of legs also can be used for further stability. Other configurations of leg assemblies are acceptable, so long as they provide the necessary support functions. The art table 10 also includes a lower tray 25 positioned under the top surface 12 and connecting the first end 15 to the second end 18.

The top surface 12 is a substantially flat surface, preferably rectangular with four corners, although other shapes or configurations also can be used as desired, and generally is made from wood or other durable, strong material. The top surface 12 is preferably smooth to enable painting, drawing and writing activities to be done thereon without disruption or disturbance from bumps, pits, etc. The top surface 12 is generally mounted on the top of and supported by a pair of side beams 26. The side beams 26, preferably made from wood, metal or a sturdy plastic material, are mounted to and extend along the sides of the table between the legs 21. The table top 11 also can be alternatively mounted directly onto the four legs 21 through use of brackets (not shown) that are attached to each of legs 21. In this case the table top 11 and top surface 12 not only serves as the drawing surface, but also provides a structural support function to the art table 10. The top surface 12 preferably should not have sharp edges so as to prevent injury to children and/or tearing off the drawing paper.

Each end 15 and 8 of the table 10 has two legs 21, mounted one at each corner of the first and second ends 15 and 18, with legs 21 generally made from wood, metal or a plastic material. The pairs of legs are connected by an upper brace 28 securing the leg's top end and a lower brace 30 securing the leg's lower portion. The upper brace 28 is mounted on the top end of two legs 21 and leaving a space between itself and the top surface 12. The upper brace 28 is alternatively mounted under the top surface 12 providing support for the top surface 12.

As shown in FIG. 1, the first end 15 further includes a paper dispenser 32. Each leg 21 of the first end 15 has a slot or recess 34 for receiving the paper dispenser 32. The slots 34 are preferably cut at a negative angle in reference to the horizontal level, so that the slot 34 is angled downwardly to thus hold the paper in place by its own weight. The paper dispenser 32 generally comprises a rod 36 made from wood, metal or other similar material. The rod 36 preferably has sufficient length to fit within into the two slots 34 on the two legs 20, so that the rod 36 can be slid into and out of the slots 34 for mounting and changing out a paper roll. Once the rod 36 holding the paper roll is slid back into the slots 34, the rod 36 generally will be mounted within the slots 34 by the weight of the paper. Additional locking means (not shown) also can be mounted on each slot 34 to prevent the roll of paper from inadvertently sliding out of the slots 34 and injuring children.

Figure 2:
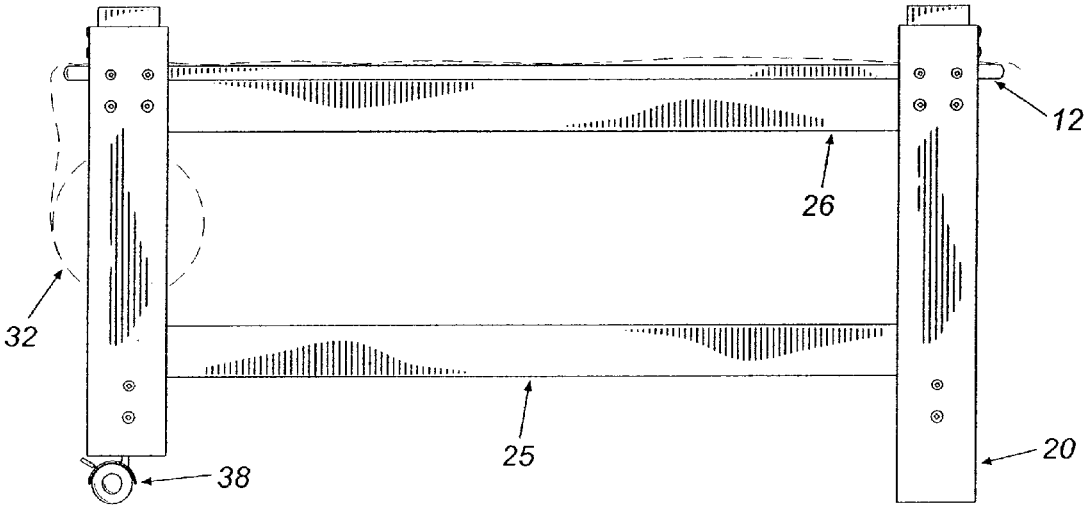
FIG. 2 is a front elevational view of the art table.
Figure 3:
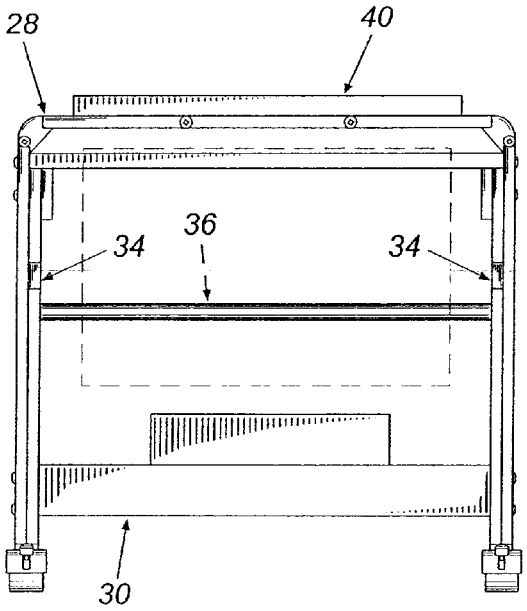
FIG. 3 is a left end view of the art table.
Figure 4:
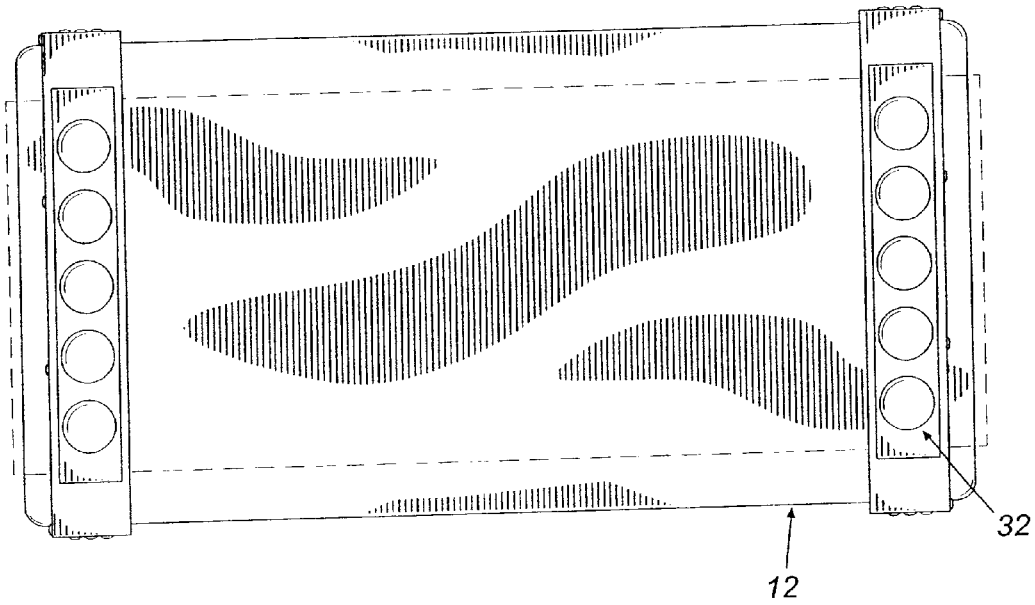
FIG. 4 is a plan view of the art table.

In addition, as shown in FIGS. 1–3, each leg 21 of the first end 15 optionally includes a swivel roller or caster wheel 38 mounted on the bottom of each leg 21. The wheels 38 generally will have locking mechanisms or brakes to secure the wheels against rolling when the table is in its normal rest position. The wheels enable easy moving of the table without requiring the art table 10 to be physically lifted and carried or dragged potentially scratching the floor with the table legs 21. The locking mechanism of each wheel, when activated, impedes the art table 10 from moving freely, thus making the art table 10 a firm, stable platform for drawing or painting. Each leg 21 of the second end 18 also can be optionally mounted with a swivel roller wheel 38 with locking mechanisms or similar types of wheels for easy moving as legs 21 of the first end 15. If all four legs 21 are mounted with swivel roller wheels 38, all wheels 38 preferably need to be locked to prevent the art table 10 from sliding when children are painting or drawing.

The lower tray 25 is preferably made from wood or a plastic material, and generally comprises a substantially flat surface with four side walls defining a storage bin for storing drawings and drawing supplies. As shown in FIG. 1, the lower tray is positioned under the top surface 12 of the table top 11 and connects the lower brace 30 of the first end 15 to the lower brace 30 of the second end 18. Alternatively, the lower tray 25 can be attached directly onto the lower portions of the four legs 21. The lower tray 25 thus serves a further structural support role by linking the lower braces 30 or potentially eliminating the need for the lower braces 30. The lower tray 25 alternatively can comprise a substantially flat surface without side walls.

The upper braces 28 of both the first end 15 and second end 18 are alternatively used to mount/support a series of holders 40 for holding drawing supplies. In addition, lighting devices (not shown) can be mounted to the upper braces 28 for providing illumination to the top surface 12. These holders 40 generally include a plurality of cups connected together as shown in FIG. 1 or alternatively can include a continuous tray (not shown). The holders 40 generally are removably mounted on the upper braces 28 through hook-and-loop fasteners, such as Velcro®, or other similar attaching means, or alternatively, the holders 40 can be permanently mounted onto the upper braces 28 with adhesive, screws or other attaching means. The lighting fixtures or devices (not shown) are alternatively releasably mounted to one of the upper braces 28 using clamps or other mounting means.

The art table 10 is preferably built with adequate dimensions suitable for a child's use, with any corners and edges being rounded and or smoothed so as to minimize potential for injuries to children.

In an alternative embodiment, the upper braces 28 further comprise a plurality of openings suitable for receiving cups in which drawing materials are placed. Drinking cups can also be placed into these openings. In yet another embodiment, the holders 40, openings, and lighting fixtures are alternatively attached onto the art table 10 with the holders 40 positioned on one upper brace 28 and the openings and lighting fixtures on the other upper brace 28. Other arrangements or combinations are possible.

While in use, the art table 10 presents itself attractively to children as their own personal drawing space. Parents can move it easily to any room in the house by lifting the end without the swivel roller wheels 38 and pushing the table so that it rolls the swivel roller wheels. After placing the art table 10 in a selected place, the art table 10 is made immobile by locking the swivel roller wheels 38, thus preventing it from being moved by children to unsupervised areas.

Parents can teach children to place all drawing tools and supplies in the art table 10. Pencils, color markers or crayons can be placed into the holders 40, and other, bigger items, including finished drawings, can be placed into the lower tray 25. Extra blank paper, typically packaged in a roll, can be placed in the paper dispenser 32, or if it not packaged in a roll, can be placed in the lower tray 25 and only sheets that are needed removed and placed onto the top surface 12.

To place a paper roll into the paper dispenser 32, the rod 36 is slid or otherwise removed from the slots 34. The rod 36 is then inserted into the center hole of the paper roll, and then the rod 36 is slid back into the slots 34. If the slots 34 are fitted with locking means, they should be locked after the paper roll is in place, thus preventing the paper roll from being accidentally pulled out from the slots 34. The paper is then pulled from the roll in a substantially continuous sheet and slid through the opening between the upper brace 28 and the top surface 12 and onto the top surface 12 of the table top for drawing. If the upper brace 28 is positioned under the top surface 12, the paper can be pulled away from the roll and placed directly onto the top surface 12. The paper further can be fixed onto the top surface with the use of adhesive tape, clips or other securing mechanisms as to prevent it from sliding while children are drawing.

While the invention has been particularly shown and described with reference to a preferred embodiment thereof, it will be understood by those skilled in the art that various changes in form and detail maybe made without departing from the spirit and scope of the present invention as set for the in the following claims.

We claim:

1. An art table comprising:

a support structure;

a top member supported by said support structure, said top member defining a substantially flat activity surface, said top member being an elongated member having a first end and a longitudinally displaced second end, wherein said support structure includes a first brace member extending over said top member;

an elongated tray supported by said support structure beneath said top member, wherein said support structure includes a first leg assembly proximate said first end of said top member and a second leg assembly proximate said second end of said top member, and wherein said elongated tray is mounted to and extends between said first and second leg assemblies; and, a paper dispensing assembly and a plurality of supply holders supported by said support structure, said paper dispensing assembly being supported below said top member adjacent said first end, said plurality of supply holders being supported above said top member, and wherein said plurality of supply holders includes a first plurality of supply holders supported by said first brace member above said activity surface and proximate one end of said top member.

2. The art table of claim 1, wherein said support structure includes a second brace member extending over said top member, and wherein said plurality of supply holders includes a second plurality of supply holders supported by said second brace member above said activity surface and proximate a second end of said top member.

3. The art table of claim 2, wherein said first leg assembly comprises two legs spaced apart, and wherein said paper dispensing assembly includes a roll dispenser mounted between said two legs.

4. The art table of claim 3, further comprising a plurality of wheels mounted to one of said first and second leg assemblies.

5. An art table comprising:

a top surface having a first end and a second end, said first end having a first pair of legs connected by a first brace extending over said top surface and said second end having a second pair of legs connected by a second brace extending over said top surface;

a paper dispenser positioned between said first pair of legs of said first end for dispensing paper onto said top surface; and, a tray position under said top surface and extending between said first and second ends.

6. The art table of claim 5, and further comprising a plurality of wheels attached to at least one of said first and second pairs of legs.

7. The art table of claim 5, further comprising a plurality of holders mounted on at least one of said first and second ends.

8. The art table of claim 5, wherein each of said first and second braces further comprises a plurality of openings for receiving a plurality of holders.

* * * * *